US010548356B2

(12) United States Patent
Flockton et al.

(10) Patent No.: US 10,548,356 B2
(45) Date of Patent: Feb. 4, 2020

(54) SWIMMING GARMENTS

(71) Applicant: SPEEDO INTERNATIONAL LIMITED, London (GB)

(72) Inventors: Karen Flockton, London (GB); Ben Hardman, Finchley (GB); Tim Sharpe, Finchley (GB); Chris Johnson, Finchley (GB); Dawn Nixon, Finchley (GB); Joseph Santry, Finchley (GB)

(73) Assignee: SPEEDO INTERNATIONAL LIMITED, Greater London (GB)

( * ) Notice: Subject to any disclaimer, the term of this patent is extended or adjusted under 35 U.S.C. 154(b) by 345 days.

(21) Appl. No.: 15/504,622

(22) PCT Filed: Aug. 14, 2015

(86) PCT No.: PCT/GB2015/052360
§ 371 (c)(1),
(2) Date: Feb. 16, 2017

(87) PCT Pub. No.: WO2016/027068
PCT Pub. Date: Feb. 25, 2016

(65) Prior Publication Data

US 2017/0245561 A1 Aug. 31, 2017

(30) Foreign Application Priority Data

Aug. 22, 2014 (GB) ..... 1414945.4

(51) Int. Cl.
*A41D 13/00* (2006.01)
*A41D 13/012* (2006.01)
(Continued)

(52) U.S. Cl.
CPC ..... *A41D 13/012* (2013.01); *A41D 7/00* (2013.01); *A41D 27/245* (2013.01); *A41D 31/02* (2013.01); *A41D 2600/10* (2013.01)

(58) Field of Classification Search
CPC ..... A41D 13/012; A41D 7/00; A41D 27/245; A41D 31/02; A41D 2600/00
See application file for complete search history.

(56) References Cited

U.S. PATENT DOCUMENTS 4,698,847 A * 10/1987 Yoshihara ..... A41B 9/08 2/406
4,946,453 A * 8/1990 Monson ..... A41D 13/0017 2/2.15
(Continued)

FOREIGN PATENT DOCUMENTS

CA 2 756 969 11/2011
JP 11-279810 10/1999
(Continued)

OTHER PUBLICATIONS

Written Opinion, International Application No. PCT/GB2005/052360, International Filing Date: Aug. 14, 2015, 8 pages.
(Continued)

*Primary Examiner* — Richale L Quinn
(74) *Attorney, Agent, or Firm* — Marvin Petry; Stites & Harbison PLLC

(57) ABSTRACT

A swimming garment formed from a stretchable elasticated fabric that, in use, covers at least part of the wearer's thighs, hips and glutes. The garment includes at least two tension bands that have a higher modulus of elasticity than adjacent regions of the stretchable elasticated fabric so that, in use, the tension bands offer greater resistance to stretch than the adjacent regions. A first one of said tension bands follows a path that extends along the outside of a left thigh region of the garment to a left hip region of the garment and inwardly from the left hip region across a left upper glute region of the garment towards a mid-line of the garment. A second one of said tension bands follows a path that extends along the outside of a right thigh region of the garment to a right hip
(Continued)

region of the garment and inwardly from the right hip region across a right upper glute region of the garment towards a mid-line of the garment.

6 Claims, 3 Drawing Sheets

(51) Int. Cl.

| | |
|---|---|
| ***A41D 7/00*** | (2006.01) |
| ***A41D 27/24*** | (2006.01) |
| ***A41D 31/02*** | (2019.01) |

(56) References Cited

U.S. PATENT DOCUMENTS

| | | | | |
|---|---|---|---|---|
| 5,109,546 | A * | 5/1992 | Dicker | A41D 13/0015 2/227 |
| 5,201,074 | A * | 4/1993 | Dicker | A41D 13/0015 2/227 |
| 5,263,923 | A * | 11/1993 | Fujimoto | A41D 13/0015 602/62 |
| 5,367,708 | A * | 11/1994 | Fujimoto | A41D 13/0015 2/22 |
| 5,745,917 | A | 5/1998 | Dicker et al. | |
| 5,839,112 | A | 11/1998 | Dicker et al. | |
| 5,937,442 | A * | 8/1999 | Yamaguchi | A41D 13/0015 2/115 |
| 6,176,816 | B1 | 1/2001 | Dicker et al. | |
| 6,195,801 | B1 | 3/2001 | Meyers | |
| 6,279,161 | B1 * | 8/2001 | Johnston | A41D 13/0015 2/115 |
| 6,401,497 | B1 | 6/2002 | Nishiyama et al. | |
| 6,446,264 | B2 * | 9/2002 | Fairhurst | A41D 7/00 2/2.15 |
| 7,074,204 | B2 | 7/2006 | Fujii et al. | |
| 7,559,093 | B2 * | 7/2009 | Sudo | A41C 1/003 2/227 |
| 7,934,267 | B2 | 5/2011 | Nordstrom et al. | |
| 7,937,771 | B2 * | 5/2011 | Mazzarolo | A41D 13/02 2/456 |
| 8,196,220 | B2 * | 6/2012 | Rance | A41D 7/00 2/67 |
| 8,533,864 | B1 | 9/2013 | Kostrzewski | |
| 8,832,863 | B2 * | 9/2014 | Yang | A63B 21/0552 2/69 |
| 8,850,619 | B2 * | 10/2014 | Rush | A41D 1/08 2/228 |
| 9,144,252 | B1 * | 9/2015 | Kostrzewski | A41D 1/08 |
| 9,572,378 | B2 | 2/2017 | Canales et al. | |
| 9,642,401 | B2 * | 5/2017 | Yamada | A41D 13/0015 |
| 9,763,483 | B2 * | 9/2017 | Waller | A41D 7/00 |
| D809,245 | S * | 2/2018 | Yeomans | D2/731 |
| 10,039,330 | B2 * | 8/2018 | Tanaka | A41D 13/0015 |
| 10,039,331 | B2 * | 8/2018 | Vauge-Lalanne | A41D 1/082 |
| D841,938 | S * | 3/2019 | Yeomans | D2/731 |
| 2004/0255358 | A1 * | 12/2004 | Ota | A41D 13/0015 2/69 |
| 2005/0198722 | A1 * | 9/2005 | Nordstrom | A41D 7/00 2/67 |
| 2007/0006356 | A1 * | 1/2007 | Shiue | A41D 31/065 2/2.15 |
| 2007/0033696 | A1 * | 2/2007 | Sellier | A41D 13/0017 2/69 |
| 2008/0078008 | A1 * | 4/2008 | Demarest | A41D 7/00 2/115 |
| 2008/0083055 | A1 | 4/2008 | Onda | |
| 2008/0141430 | A1 * | 6/2008 | Rance | A41D 7/00 2/67 |
| 2008/0256675 | A1 * | 10/2008 | Di Lorenzo | A41D 7/00 2/67 |
| 2008/0295216 | A1 * | 12/2008 | Nordstrom | A41D 13/0015 2/69 |
| 2009/0025115 | A1 | 1/2009 | Duffy et al. | |
| 2009/0038047 | A1 * | 2/2009 | Di Lorenzo | A41D 7/005 2/67 |
| 2009/0062704 | A1 | 3/2009 | Brown et al. | |
| 2009/0082182 | A1 | 3/2009 | Lloyd | |
| 2009/0113596 | A1 * | 5/2009 | Young | A41D 13/0015 2/69 |
| 2009/0172858 | A1 | 7/2009 | Oya et al. | |
| 2010/0115681 | A1 | 5/2010 | Butterfield et al. | |
| 2010/0162466 | A1 | 7/2010 | Fukuyo et al. | |
| 2011/0209263 | A1 | 9/2011 | Suzuki et al. | |
| 2011/0209267 | A1 | 9/2011 | Rush et al. | |
| 2011/0237995 | A1 | 9/2011 | Ota et al. | |
| 2013/0104280 | A1 | 5/2013 | Boynton | |
| 2013/0160189 | A1 | 6/2013 | Yang | |
| 2014/0096301 | A1 * | 4/2014 | Waller | A41D 7/00 2/67 |
| 2014/0333089 | A1 | 11/2014 | Brooks et al. | |
| 2014/0338089 | A1 | 11/2014 | Brooks et al. | |
| 2015/0201682 | A1 | 7/2015 | Musciacchio | |
| 2015/0201685 | A1 | 7/2015 | Musciacchio | |
| 2017/0079339 | A1 * | 3/2017 | Yeomans | A41D 7/005 |
| 2019/0090562 | A1 * | 3/2019 | Moore | A41D 31/02 |

FOREIGN PATENT DOCUMENTS

| | | |
|---|---|---|
| JP | 2001-262409 | 9/2001 |
| JP | 2002-212810 | 7/2002 |
| JP | 2007-314931 | 12/2007 |
| JP | 2008-280656 | 11/2008 |
| WO | WO 2009/149747 | 12/2009 |

OTHER PUBLICATIONS

International Search Report, International Application No. PCT/GB2005/052360, International Filing Date: Aug. 14, 2015, 5 pages.
Notification of Transmittal of the International Search Report and the Written Opinion of the International Searching Authority, or the Declaration for PCT/GB2005/052360, dated Oct. 23, 2015.
Great Britain Search Report under Section 17(6), Application No. GB1414945.4, dated Feb. 16, 2015, 4 pages.
International Search Report, International Application No. PCT/GB2015/052360, dated Oct. 23, 2015, 3 pages.

* cited by examiner

SWIMMING GARMENTS

TECHNICAL FIELD

The present invention relates generally to swimming garments, such as swimsuits, triathlon suits, waterpolo suits, wetsuits and other garments intended to be worn by a person when swimming. A preferred use is for swimsuits intended for competition swimmers.

BACKGROUND

Swimmers typically wear tight fitting garments which help decrease air/water resistance, which is especially important in competitive events. If maximum performance is to be achieved then it is also very important the swimmer maintains a correct body position when executing a swimming stroke in the water. This requires coordinated firing of specific muscle groups depending on the stroke. Such body position, including the coordinated firing of muscle groups, is generally only learned and maintained through hours of training in a pool.

Swimming garments have been proposed that support a swimmer's core to help them maintain good body position in the water. For example, EP1935266 (Speedo) describes a swimsuit having increased support for a swimmer's core, provided by a double layer of fabric in a torso region of the suit that surrounds the swimmers abdomen and lumbar region.

SUMMARY OF THE INVENTION

It is a general aim of embodiments of the present invention to offer a swimming garment that better assists the swimmer to maintain a good body position, at least in part by encouraging coordinated firing of relevant muscle groups. In general terms, the approach proposed in embodiments of the invention is to provide tension bands (for example stitched or bonded seams) within the garment that, when the garment is worn, generally follow the natural paths (e.g. of muscles, connective tissues and/or bones) in the body that connect relevant muscle groups in a swimmer's body. This can provide proprioceptive feedback to the swimmer to help initiate coordinated firing of the connected muscle groups and/or to help the user to maintain good positioning and/or stabilisation of the associated joints and bones.

For example, crossed seam lines (or other tension bands) on the back of a swimming garment can be configured to generally follow the posterior oblique myofascial lines of the swimmer to connect the swimmer's gluteal muscles ("glutes") to muscles on the back of the opposite shoulder (including the latissimus dorsi, "lats"). This helps with proprioceptive feedback to remind the body to fire the glutes when the opposite lat is working to get sequenced timing between the left shoulder and right hip and vice versa, which can help with dynamic co-ordination and sequenced timing. The connection with the crossed seam lines can also help with proprioceptive feedback to fire the gluteal muscles to help maintain pelvic position (more posteriorly tilted into neutral and neutral lumbar spine) and also maintain good scapula position (slightly posteriorly rotated, retracted and depressed flat against the posterior chest wall) while initiating the scapula stabilising muscles (mainly the serratus anterior and lower fibres trapezius).

The invention provides a swimming garment formed from a stretchable elasticated fabric that, in use, covers at least part of the wearer's thighs, hips and glutes, the garment including at least two tension bands that have a higher modulus of elasticity than adjacent regions of the stretchable elasticated fabric so that, in use, the tension bands offer greater resistance to stretch than the adjacent regions;

wherein a first one of said tension bands follows a path that extends along the outside of a left thigh region of the garment to a left hip region of the garment and inwardly from the left hip region across a left upper glute region of the garment towards a mid-line of the garment; and a second one of said tension bands follows a path that extends along the outside of a right thigh region of the garment to a right hip region of the garment and inwardly from the right hip region across a right upper glute region of the garment towards a mid-line of the garment.

The term "thigh region" of a garment is intended to refer to the region that, when the garment is worn as intended, overlies the wearer's thigh. In some embodiments it is intended to overly the wearer's Iliotibial (IT) Band.

The term "hip region" of a garment is intended to refer to the region that, when the garment is worn as intended, overlies the wearer's hip. In some embodiments it is intended to overly the 'greater trochanter, i.e. the point of rotation of the upper leg/thigh.

The term "upper glute region" of a garment is intended to refer to the region that, when the garment is worn as intended, overlies an upper portion of the wearer's gluteus muscles.

In some embodiments, in use, the stretchable elasticated fabric of the swimming garment also covers at least part of the wearer's abdomen, chest and back. In such cases, the path of the first tension band may further extend from the left upper glute region of the suit across the back of the suit and to a right rear shoulder region of the suit and the path of the second tension band extends from the right upper glute region of the suit across the back of the suit and to a left rear shoulder region of the suit. With this configuration, the first and second tension bands can cross one another at the mid-line of the suit in a lower back region of the suit.

The term "rear shoulder region" of a garment is intended to refer to the region that, when the garment is worn as intended, overlies the rear of the wearer's shoulder. In some embodiments it is intended to overly the wearer's Latissimus dorsi.

The term "lower back region" of a garment is intended to refer to the region that, when the garment is worn as intended, overlies the wearer's lower back or lumbar region. In some embodiments it is intended to overly the sacrum, the sacro-iliac joints or the joint between the sacrum and the lowest lumbar vertebrae.

In some embodiments the paths of the tension bands in the garment are such that when the suit is worn the first and second tension bands generally follow the posterior oblique myofascial lines of the wearer.

In some embodiments the tension bands comprise seams in the garment. The seams may, for example, join separate panels of the stretchable elasticated fabric from which the garment is formed. The seams may be stitched seams, bonded seams (e.g. ultrasonically welded, lap-bonded or another appropriate form of bonding) or a combination of the two. The seams may be taped on the inside or on the outside. In some embodiments the seams may be taped (i.e. have a tape bonded to them) on the inside and the outside.

In some embodiments the tension bands are not associated with a seam. For example, the tension bands comprise tapes fixed (e.g. bonded) onto a fabric panel to provide a line of higher tension/modulus in order to achieve mechanical advantage or proprioceptive benefit.

In some embodiments, the swimming garment includes further tension bands on the front of the garment, in particular a third one of said tension bands that follows a path from a left hip region of the garment onto the front of the garment over an upper left pelvis region of the garment to a left rib-cage region of the garment and then across a left lateral chest region of the garment back towards the left side of the garment adjacent a left arm opening in the garment and a fourth one of said tension bands that follows a path from a right hip region of the garment onto the front of the garment over an upper right pelvis region of the garment to a right rib-cage region of the garment and then across a right lateral chest region of the garment back towards the right side of the garment adjacent a right arm opening in the garment.

The term "hip region" of a garment, as already noted above, is intended to refer to the region that, when the garment is worn as intended, overlies the wearer's hip. In some embodiments it is intended to overly the 'greater trochanter, i.e. the point of rotation of the upper leg/thigh The term "upper left (right) pelvis region" of a garment is intended to refer to the region that, when the garment is worn as intended, overlies the upper left (or right) part of the wearer's pelvis. In some embodiments it is intended to overly the wearer's left (or right) anterior superior iliac spine (i.e. the anterior extremity of the iliac crest of the pelvis).

The term "rib-cage region" of a garment is intended to refer to the region that, when the garment is worn as intended, overlies wearer's rib cage. In some embodiments it is intended to overly the wearer's rib cage at the $5^{th}$ or $6^{th}$ rib.

The term "lateral chest region" of a garment is intended to refer to the region that, when the garment is worn as intended, overlies a lateral region of the wearer's chest. In some embodiments it is intended to follow the line of the lateral side of the wearer's pectoralis major.

In some embodiments, the third tension band meets the first tension band at said left hip region and the fourth tension band meets the second tension band at said right hip region.

In some embodiments, a swimming garment may include the front tension bands (i.e. third and fourth tension bands) without the rear tension bands.

DETAILED DESCRIPTION

The invention will now be further described with reference to the following non-limiting Figures and Examples. Other embodiments of the invention will occur to those skilled in the art in the light of these.

Figure 1:
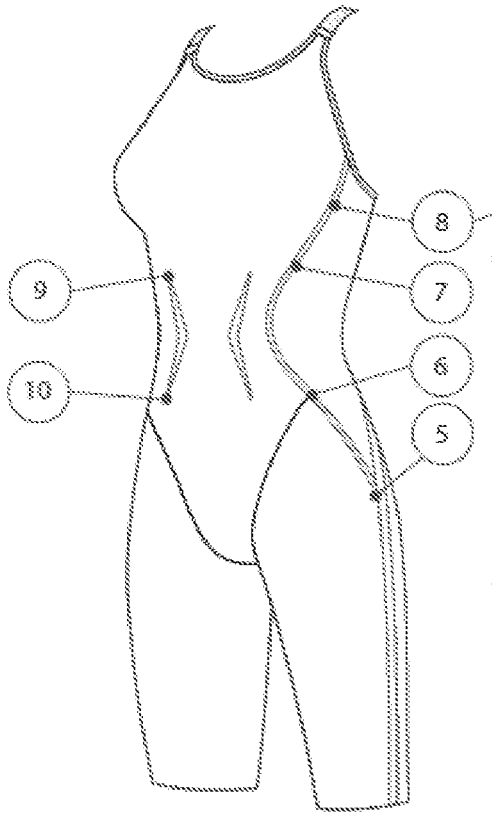
FIG. 1 shows a front perspective view of a swimsuit in accordance with an embodiment of the present invention.
Figure 2:
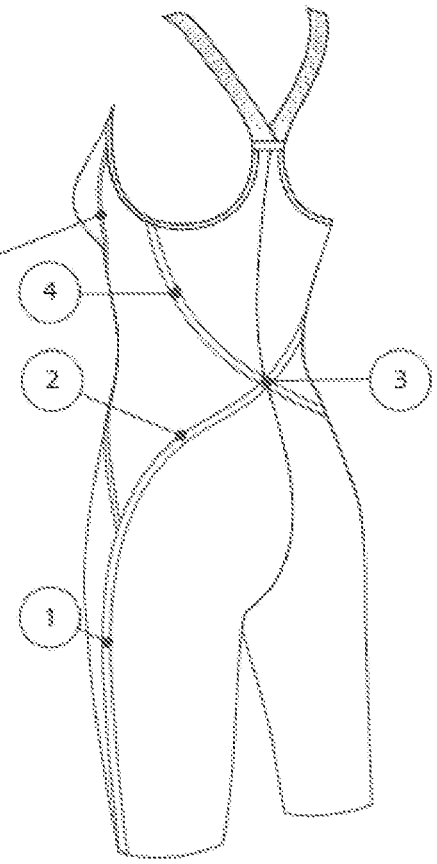
FIG. 2 shows a rear perspective view of the swimsuit of FIG. 1.

Referring to FIGS. 1 and 2, a swimsuit in accordance with a first exemplary embodiment of the invention is described. The swimsuit is a female suit intended for competitive swimming and is formed from a stretchable elasticated fabric of a type known for use in competition swimsuits.

In this example, the swimsuit is of a 'closed back kneeskin' type. As such, the suit includes left and right leg portions that extend down to the swimmer's knees and cover their thighs, a torso portion that covers the abdomen and the back (extending up to the bottom of the scapula) and a chest portion that covers the swimmer's chest. The suit has shoulder straps that extend from the top of the chest portion, at spaced apart points on each shoulder, over the shoulder to a central point at the top of the back portion, between the scapula. Arm openings are defined by the top edges of the chest and back portions in combination with the shoulder strap.

In accordance with an embodiment of the invention, the swimsuit includes front and rear tension bands, which offer greater modulus (or resistance to stretch) along their length than the modulus of the basic stretchable elasticated fabric fabric of the suit. In this example, these tension bands are formed by bonded seams in the suit that join adjacent panels of the stretchable elasticated fabric fabric. The seams are taped on the inside of the suit.

More specifically, the rear tension bands are provided by crossed seam lines on the back of the suit that, when the suit is worn, follow the posterior oblique myofascial lines: the IT Band (1) into Glutes (2) on one side, across the Sacrum (3) to the opposite Latissimus dorsi (4) up into the shoulder on that opposite side. The two seam lines cross one another over the sacrum.

The front tension bands are provided by seam lines that, when viewed from the front, have a generally hour glass appearance to follow, when the suit is worn, skeletal landmarks and myofacial lines (muscle chains) to provide stability to the core region (upper and lower abdominals). These front seam lines connect to the rear seam lines at the greater trochanter (5), this being the point of rotation of the upper leg/thigh. The seam lines then run over the front of the pelvis at the anterior superior iliac spine (6) and then to the rib cage at the 5th/6th rib (7). The seam then follows the line of the pectorialis major (8) up to the armhole of the suit.

In this example, two features (referred to in the following as 'sensitivity zones') are formed on the front of the suit over the abdomen. In general terms, these sensitivity zones are areas in the suit that have a thinner fabric covering than surrounding areas of the suit to give a heightened sensation in a very specific position of the body, in this example the upper abdominals (9) and lower abdominals (10).

Figure 5:
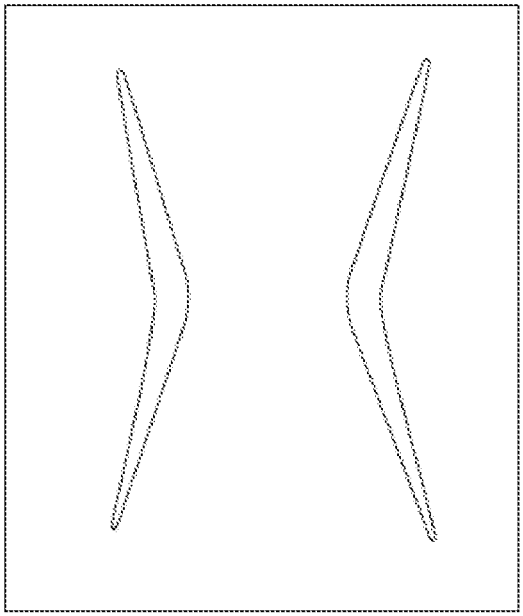
FIG. 5 shows, on an enlarged scale, a feature that is seen on the front of the swimsuits of FIGS. 1 and 3.

As seen in FIGS. 1 and 5, in this example there are two chevron-shaped sensitivity zones spaced apart one to either side of the midline of the front of the suit, with each pro hole extending from an upper region (9) of the abdominals to a lower region (10) of the abdominals.

In this example, the abdominal region of the suit is formed from two (or more) layers of fabric (e.g. two stretchable elasticated fabric fabric layers) and the sensitivity zones are created to provide the desired heightened sensation by removing one layer of fabric to increase the sensation of water flow/temperature which in-turn leads to a proprioceptive response in order to activate this muscle group and maintain a good relative anterior positioning between pelvis and ribcage. This leads to a more neutral pelvis and lumber spine position.

In other examples, to avoid using a double layer fabric region, the thinner areas of fabric to form the sensitivity zones can be produced by processing a fabric panel to produce localised thinning. For example, laser-etching of the surface layer of a fabric can create a localised thinner area within the fabric panel.

Alternatively, the fabric could be formed in the first instance with regions of differing thickness in order to provide the sensitivity zones. For example, a circular knitting process could be used to produce a 3D fabric panel (i.e. a panel with variation in thickness) or even a semi-complete suit. This production technique can produce a garment panel with thicker and thinner areas by design rather than using a secondary process to thin areas of the fabric.

The seam lines and sensitivity zones in the front of the suit are to give proprioceptive feedback to the lower abdominal region to initiate a more posterior pelvic tilt to help maintain a more neutral lumbar spine position ("flat lower back") and avoid excessive anterior pelvic tilt which can cause lumbar lordosis (extension). The cross seam lines on the back of the suit aim to connect the Gluteals and posterior chain muscles with the muscles on the back of the opposite shoulder, following the lines of the posterior oblique myofascial lines (IT Band into Glutes on one side, across the sacrum to the opposite Latissimus dorsi up into the shoulder on that side). This helps with proprioceptive feedback to fire the gluteal muscles to help maintain pelvic position (more posteriorly tilted into neutral and neutral lumbar spine) and also maintain good scapula position (slightly posteriorly rotated, retracted and depressed flat against the posterior chest wall) while initiating the scapula stabilising muscles (Serratus anterior, lower fibres trapezius mainly).

Thus it can be seen that in this example, the front and rear seams/sensitivity zones play slightly different roles. The seams in the front of the suit give purely proprioceptive feedback to the abdominal region to maintain a good pelvic position and a flat lower back. The crossed seams in the rear follow the posterior oblique myofascial lines to give proprioceptive feedback to connect this group of muscles. This then helps the glutes to fire and in turn maintain the good pelvic position (as with the front seams). By encouraging firing of the glutes in time with the opposite shoulder, the crossed seams on the back can also help with dynamic co-ordination and timing between upper and lower body (arms and legs).

Figures 3, 4:
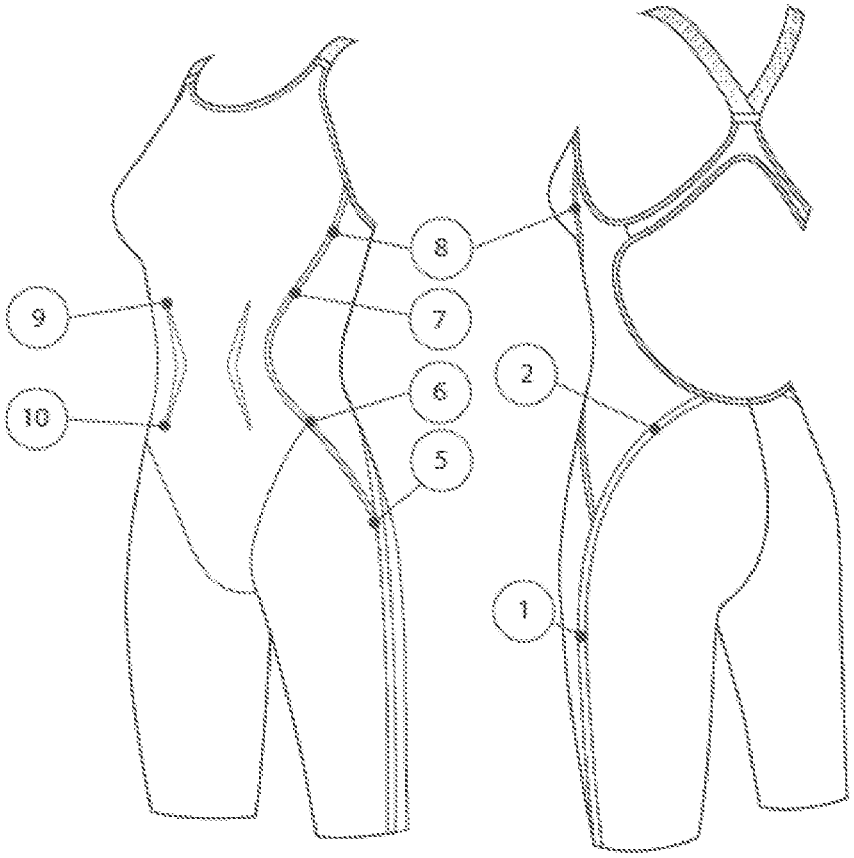
FIG. 3 shows a front perspective view of another swimsuit in accordance with an embodiment of the present invention.
FIG. 4 shows a rear perspective view of the swimsuit of FIG. 3.

FIGS. 3 and 4, show a second exemplary swimsuit in accordance with an embodiment of the invention. The suit of this example is very similar to the suit of FIGS. 1 and 2, save that in this example, the swimsuit is of an 'open back kneeskin' type. As such, it has an open back region (i.e. a region free of fabric) above the top of the glutes. The rear of the shoulder straps has a cross-like form with strap portions extending laterally and downwardly from the centre of the back between the scapula to join with the side of the chest portion of the suit. Consequently, the seams forming the rear tension bands terminate at the top of the glutes where they meet the back opening.

In other respects the example of FIGS. 3 and 4 is identical to the example of FIGS. 1 and 2, including the sensitivity zones on the abdomen and similar proprioceptive effects are obtained, although in this suit there is not the same connection between the sacrum and the latimmus dorsi. There is, however, still a benefit in connecting the IT bands to the sacro-illiac joints.

The skilled person will appreciate that the swimsuits illustrated in the Figures and described above are examples embodying inventive concepts described herein and that many and various modifications can be made without departing from the invention. For example, the same concepts can be applied to other types of swimming garment, such as triathlon suits, waterpolo suits and wetsuits for example. It is also possible to include 'sensitivity zones' and/or tension bands in alternative or additional positions on the garment to provide different or additional proprioceptive effects.

The invention claimed is:

1. A swimming garment formed from a stretchable elasticated fabric that, in use, is configured to cover at least part of the wearer's thighs, hips, glutes, abdomen, chest and back, the garment including at least four tension bands that have a higher modulus of elasticity than adjacent regions of the stretchable elasticated fabric so that, in use, the tension bands offer greater resistance to stretch than the adjacent regions;

wherein a first one of said tension bands follows a path that extends along the outside of a left thigh region of the garment to a left hip region of the garment and inwardly from the left hip region across a left upper glute region of the garment towards a mid-line of the garment;

a second one of said tension bands follows a path that extends along the outside of a right thigh region of the garment to a right hip region of the garment and inwardly from the right hip region across a right upper glute region of the garment towards a mid-line of the garment;

a third one of said tension bands that follows a path from a left hip region of the garment onto the front of the garment over an upper left pelvis region of the garment to a left rib-cage region of the garment and then across a left lateral chest region of the garment back towards the left side of the garment adjacent a left arm opening in the garment; and a fourth one of said tension bands that follows a path from a right hip region of the garment onto the front of the garment over an upper right pelvis region of the garment to a right rib-cage region of the garment and then across a right lateral chest region of the garment back towards the right side of the garment adjacent a right arm opening in the garment, wherein the tension bands comprise seams in the garment, the third tension band meets the first tension band at said left hip region of the garment and the fourth tension band meets the second tension band at said right hip region of the garment.

2. A swimming garment according to claim 1, wherein:

the path of the first tension band extends from the left upper glute region of the suit across the back of the suit and to a right rear shoulder region of the suit; and the path of the second tension band extends from the right upper glute region of the suit across the back of the suit and to a left rear shoulder region of the suit;

wherein the first and second tension bands cross one another at the mid-line of the suit in a lower back region of the suit.

3. A swimming garment according to claim 1, wherein the paths of the tension bands are such that when the suit is worn the first and second tension bands generally are configured to follow the posterior oblique myofascial lines of the wearer.

4. A swimming garment according to claim 1, wherein the seams join separate panels of the stretchable elasticated fabric from which the garment is formed.

5. A swimming garment according to claim 1, wherein the seams are stitched seams.

6. A swimming garment according to claim 1, wherein the seams are bonded seams.

* * * * *